United States Patent [19]

Koranda

[11] 4,112,852

[45] Sep. 12, 1978

[54] RAILWAY HOPPER CAR LABYRINTH GATE SEAL

[76] Inventor: Clarence J. Koranda, 5042 Lawn Ave., Western Springs, Ill. 60558

[21] Appl. No.: 754,836

[22] Filed: Dec. 27, 1976

[51] Int. Cl.[2] ..... B61D 7/02; B61D 7/20; B61D 7/22; B61D 7/26

[52] U.S. Cl. ..... 105/282 A; 105/282 P; 105/308 A; 105/308 C; 105/308 P; 277/56

[58] Field of Search ..... 105/282 R, 282 A, 282 P, 105/424, 308 A, 308 C, 308 P; 174/107; 277/56

[56] References Cited

U.S. PATENT DOCUMENTS

| | | | |
|---|---|---|---|
| 987,877 | 3/1911 | Harrigan | 105/424 X |
| 1,027,241 | 5/1912 | Coleman | 105/424 X |
| 1,136,315 | 4/1915 | Clark | 105/282 R X |
| 3,082,701 | 3/1963 | Dorey | 105/282 R X |
| 3,130,687 | 4/1964 | Smith | 105/282 P |
| 3,255,553 | 6/1966 | Dorey | 105/282 R |
| 3,569,611 | 3/1971 | Berends | 174/107 |
| 3,779,172 | 12/1973 | Schipper et al. | 105/282 A |

*Primary Examiner*—Albert J. Makay
*Assistant Examiner*—Howard Beltran

[57] ABSTRACT

A railway hopper car chute having a discharge opening defined by a sidewall frame with a sliding plate gate operating in the discharge opening. An undercarriage support frame is fixed to the sidewall frame to support the gate for sliding movements relative the opening. A labyrinth seal for preventing the unwanted discharge of granular lading comprising an upwardly directed gate flange is integrally formed on at least part of the periphery of the gate plate. The flange is disposed in the space defined by the outside of the chute frame and the inside of the undercarriage frame. A pair of spaced elongated bars is disposed in the space between the gate flange and the adjacent hopper sidewall frame. These elongated bars together with the flange form a labyrinth seal with one of the bar seal elements being fixed to the gate and the other to the adjacent chute sidewall frame. Both seal elements define a labyrinth gap therebetween which serve as a non-contact seal for any granular lading located within the chute.

10 Claims, 11 Drawing Figures

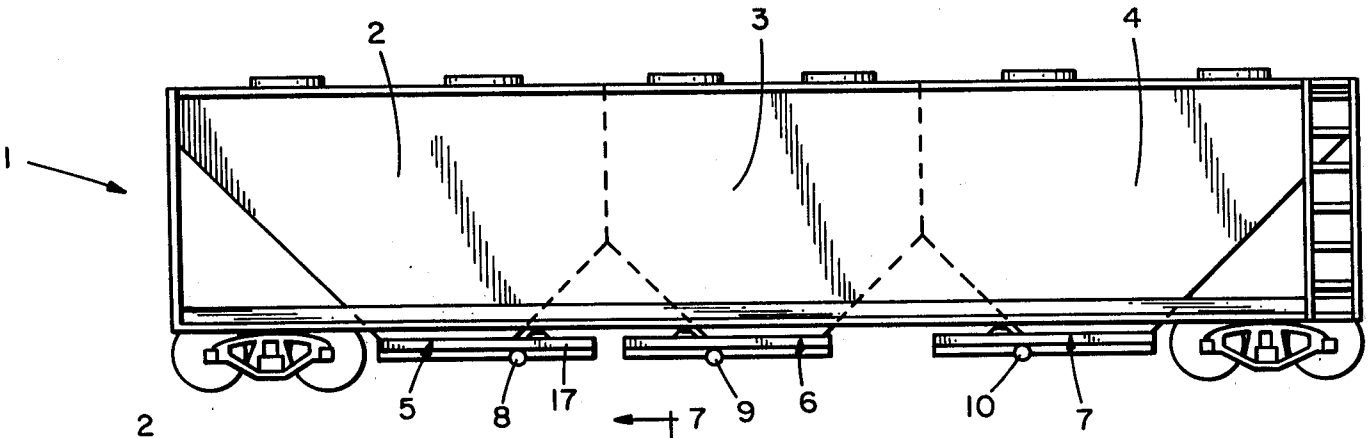
FIG. 2
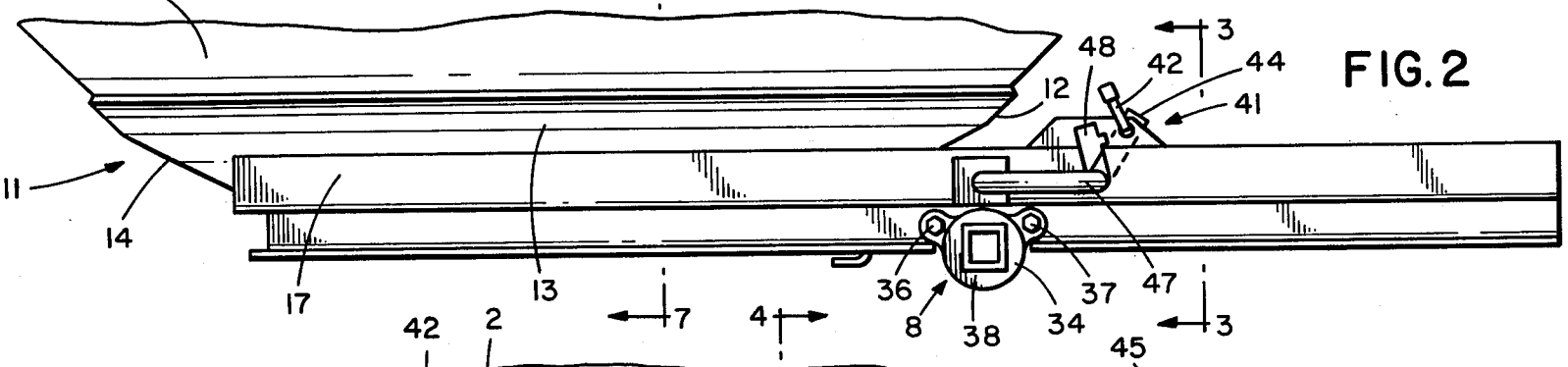
FIG. 3
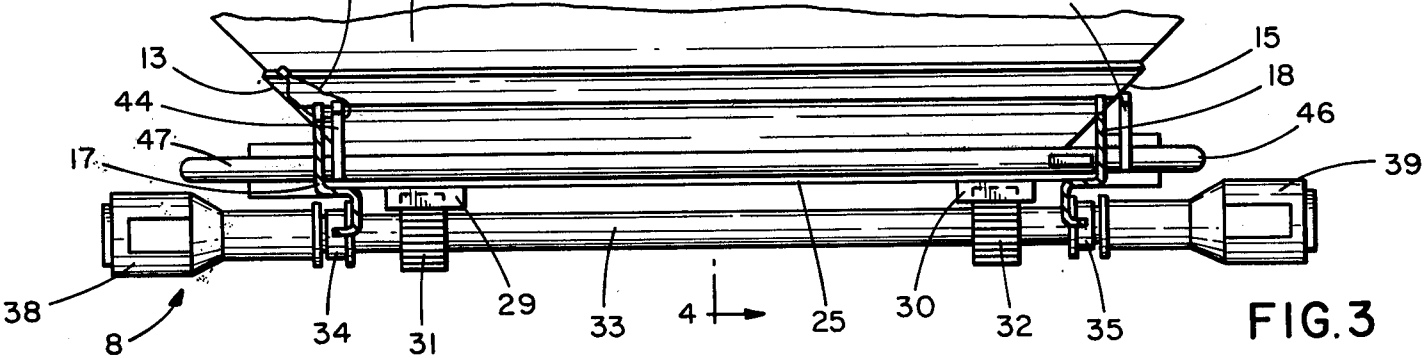

40
41
45
49
46a
43
30
33
32
8
48
26
12
53
21
20
2
18
25
19
23
14
11
6
51
15
16
24
28
52
55
50
54
13
22
17
27
29

RAILWAY HOPPER CAR LABYRINTH GATE SEAL

BACKGROUND OF THE INVENTION

When granular lading, such as bauxite, bentonite, cement, flour, and the like is loaded into a railway hopper car having a hopper outlet closed by a sliding gate, a substantial part of the lading escapes between the hopper outlet chute and the gate until sufficient lading has been retained on the gate to close off the leakage spaces.

Additionally, in order to supply air to operate diesel locomotives in relatively long tunnels, it is customary to pressurize the tunnels. When railway cars containing lading are drawn through such tunnels, the hopper compartments become pressurized and retain the pressure on emerging from the tunnel. This pressure serves to discharge some of the lading through the leakage space between the hopper chutes and the gates. The discharged lading not only represents a loss in transported materials, but also contaminates the railway roadbed so that it must be periodically removed.

The prior art is prolific in the design of seals which have been applied to such sliding gates in an effort to minimize waste of lading caused by such pressurized conditions, and losses caused by the inevitable mechanical distortion in the components used to effect such seals. Railway hopper cars are subjected to extremely severe operating conditions, and additionally, the personnel opening and closing such gates in many instances employ force and means which cause any seals dependent upon friction or tight contact to open.

Generally speaking, all of the prior art sealing arrangements attempt to employ mechanical elements, either rigid or resilient, to effect a tight friction contact seal between the relative moving slide gate and the adjacent hopper chute frame defining the hopper opening. Inevitably, due to the relatively large size of hopper car gates and the severe usage and treatment to which these gates are subjected, one or more elements of the seals become distorted and consequently the integrity of the seal is impaired to the point that lading is unnecessarily discharged. The resulting waste, of course, represents an expensive loss, as well as a discharged contaminant as far as the railway bed is concerned.

SUMMARY OF THE INVENTION

Accordingly, a principal object of this invention is to provide an effective seal between a railway hopper discharge chute and a sliding gate which in the main relies on a tortuous path before the lading can be wastefully discharged. Such a tortuous path is provided by a labyrinth seal which includes spaced elements which in a preferred embodiment includes an upwardly turned flange formed on three peripheral edges of a platelike sliding gate. The upwardly turned flanges are sandwiched between a pair of labyrinth seal bars, one of which is affixed to the outside wall of the hopper chute, and the other is affixed either to the plate body portion of the gate or to the flange. In all instances, spaces are provided between the flange and the seal bars, and a labyrinth like tortuous path is established. Contrary to expectations, the open gap and the relative positioning of the seal bars in cooperation with the flange, provide an effective seal which does not depend on the integrity of friction or contact elements.

Additionally, the labyrinth seal is so incorporated and associated with the undercarriage frame structure of a typical hopper car, that the friction contact surfaces normally employed to support the gate upon the undercarriage frame for sliding opening and closing movement is employed as a secondary seal to serve as an additional safeguarding mechanism for adding to the efficiency of the total seal. Accordingly, in order that lading may be unintentionally discharged from a hopper car compartment, it must traverse the tortuous path of a labyrinth seal and it must also ultimately traverse the friction contact provided between the sliding contact surfaces of the gate and the undercarriage frame.

An additional advantage of the foregoing structure is that the upturned flanges formed on the periphery of the rear and sides of the sliding gate also serve as a mechanism for strengthening the gate against unwanted distortions.

DESCRIPTION OF THE DRAWINGS

In order that all of the structural features for attaining the objects of this invention may be readily understood, reference is made to the accompanying drawings wherein:

FIG. 1 is a simplified side elevation view of a covered hopper car with each hopper compartment being equipped with a slide gate of this invention;

FIG. 2 is an enlarged side elevation view of a portion of a single hopper compartment incorporating a slide gate of this invention, with the gate being closed and locked;

FIG. 3 is a section view taken along line 3—3 of FIG. 2 and showing the gate operating capstan and also a preferred embodiment of a bar lock;

DETAILED DESCRIPTION OF THE PREFERRED EMBODIMENT

Figures 4, 5, 7:
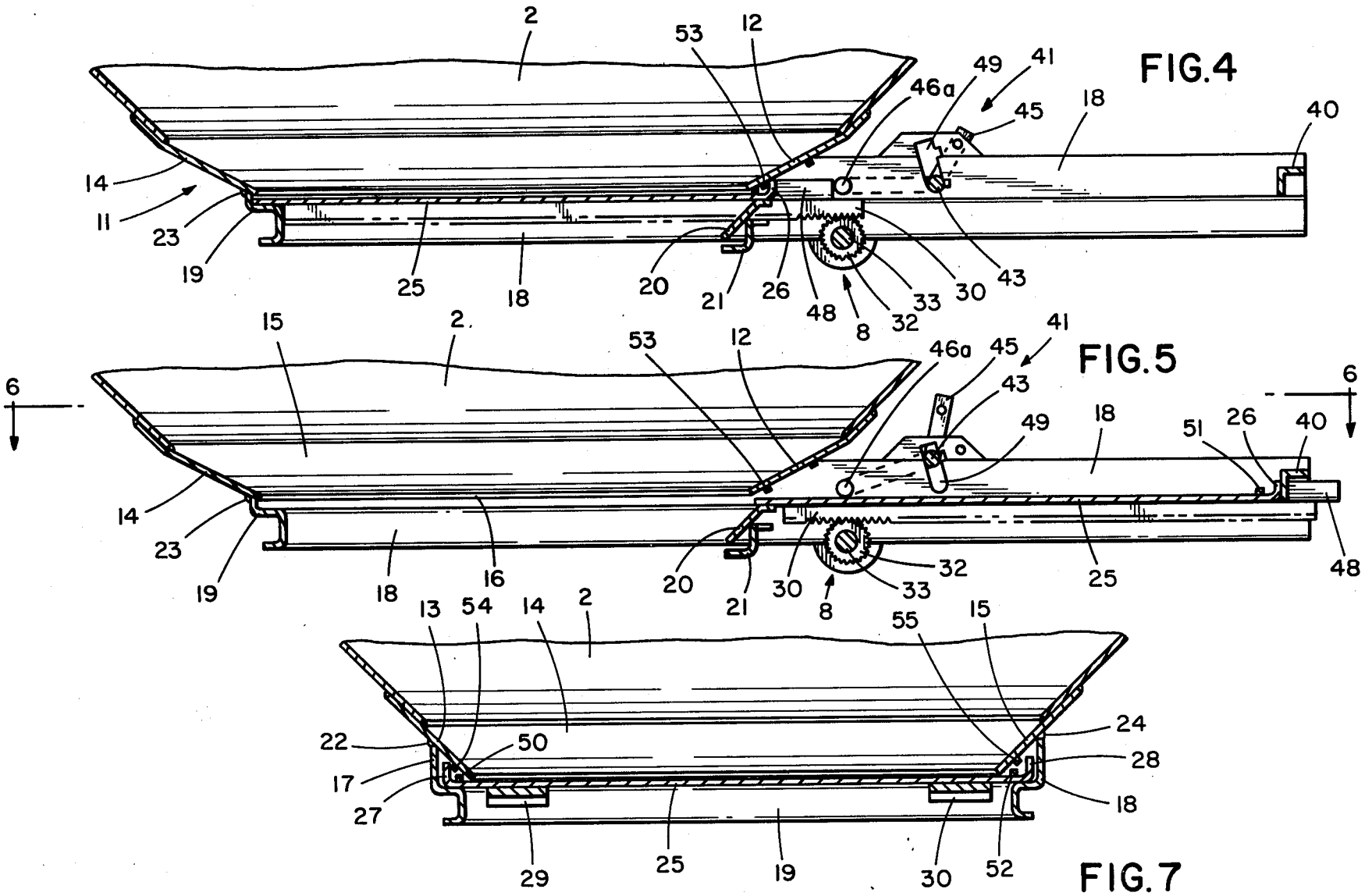
FIG. 4 is a section view taken along line 4—4 of FIG. 3 showing the gate in the closed position.
FIG. 5 is a view related to that of FIG. 4, however, the gate is shown in the open position.
FIG. 7 is a section view taken along line 7—7 of FIG. 2 showing the labyrinth seals formed on each side of the hopper gate.

FIG. 1 shows a covered railway hopper car 1 which is subdivided into three hopper compartments 2, 3 and 4. Each of the hopper compartments 2, 3 and 4 is equipped with a slide gate assembly employing the labyrinth seal of this invention. For example, hopper compartment 2 is equipped with slide gate assembly 5 which is generally shown at the bottom of the hopper chute, and similarly, hopper compartments 3 and 4 are equipped with slide gate assemblies 6 and 7.

Each of the slide gate assemblies 5, 6 and 7 are supported relative the undercarriage of hopper car 1 by undercarriage frame structure which carries a hopper outlet chute defining a framed discharge opening for granular lading. The slide gate operates within this framed opening so as to contain or release the lading as the gate is operated by capstan assembly 8, shown with respect to hopper compartment 2. Similarly, capstan assemblies 9 and 10 operate the slide gates for hopper compartments 3 and 4, respectively.

With respect to the typical hopper car 1, shown in FIG. 1, the operation of capstan 8 moves the slide gate (FIGS. 2 and 6) to the right when the gate is opened; the operation of capstans 9 and 10 moves their associated slide gates to the left when these gates are opened to permit the release of lading.

Inasmuch as the slide gate assemblies and the labyrinth seals of this invention are essentially the same for all of hopper compartments 2, 3 and 4, the specific slide gate structure for hopper compartment 2 will be discussed in detail in the subsequent Figures. It should be understood, however, that slide gate assemblies 6 and 7 and their associated labyrinth seals for hopper compartments 3 and 4, are substantially identical in structure with the exception that, as previously noted, the gates for assemblies 6 and 7 are moved to the left by operation of capstan assemblies 9 and 10 when the hopper compartments are to be opened for release of their contained lading.

The labyrinth seals of this invention are best shown in FIGS. 8 through 11. In general, these seals provide a new and novel arrangement for sealing the opening defined by the frame of the hopper outlet chute when the gate is closed. The seals in the main incorporate open gaps which define a labyrinth which, contrary to one's expectations, effectively seal the granular lading contained within a hopper. This labyrinth seal is employed rather than a seal formed solely by contact elements tightly engaged, or having a friction fit, or even incorporating resilient elements.

However, prior to discussing the detailed structure of the labyrinth seals of FIGS. 8 through 11, a description of the general arrangement of the hopper chute 11 for hopper compartment 2 is desirable for facilitating the understanding of the invention.

Hopper outlet chute 11 (FIG. 2) employs four inclined sidewalls, namely, rear sidewall 12, near sidewall 13, front sidewall 14 and far sidewall 15 (FIG. 3).

Figure 6:
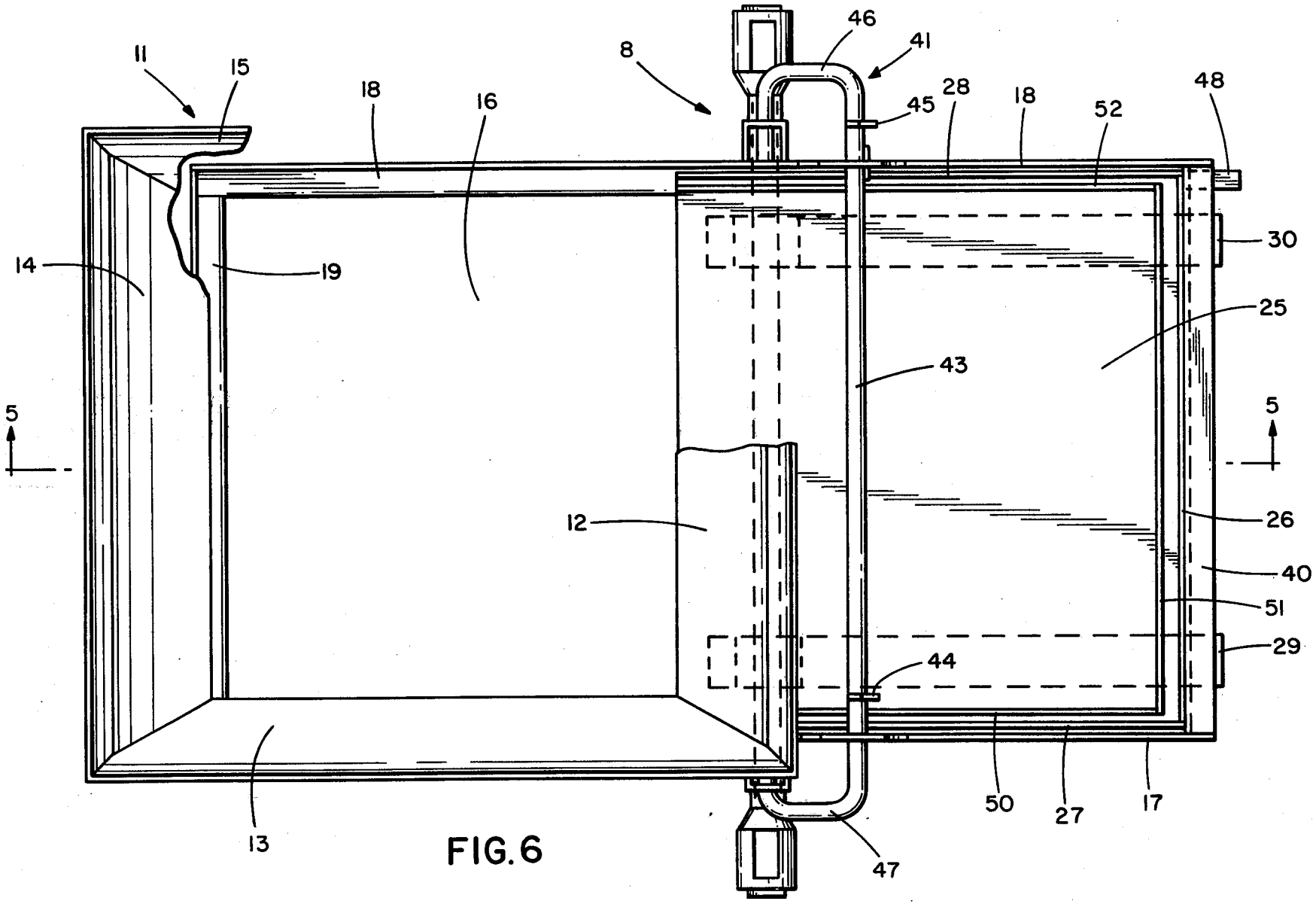
FIG. 6 is a section view taken along line 6—6 with a hopper portion of the gate being broken away to show a plan detail of the hopper gate labyrinth seal.

A rectangular discharge opening 16, best shown in FIGS. 5 and 6, is defined by the frame formed by sidewalls 12, 13, 14 and 15. Accordingly, an outlet for hopper compartment 2 is provided by hopper outlet chute 11 through the framed opening formed by sidewalls 12, 13, 14 and 15.

An undercarriage support frame comprising near side frame 17, far side frame 18 (FIGS. 2 and 3), and front side frame 19 (FIGS. 4 and 5) are rigidly fixed to the hopper outlet chute sidewalls 12, 13, 14 and 15 by welds 22, 23 and 24, together with other welds (not shown). The sidewalls forming hopper compartment 2 are also welded to the upper edges of the sidewalls forming hopper outlet chute 11, so that an integral seal is established between the compartment 2 sidewalls and the hopper outlet chute 11 sidewalls. Accordingly, the only outlet provided for granular lading is through discharge opening 16.

Inclined frame element 20 extends between and is welded to side frames 17 and 18 to strengthen further the undercarriage support structure. Additionally, element 20 serves as a lading guide baffle during an unloading operation. Angle 21 also extends between side frames 17 and 18 and is welded to the underside of frame element 20. Angle 21 serves as a boot support for an unloading chute (not shown).

Sliding gate 25 rests on the undercarriage support frame formed by frame sections 17, 18 and 19. The main body of slide gate 25 is generally rectangular and plate-like in shape with all edges of the gate plate, except the front, being formed with an upwardly directed flange. In particular, the rear edge of gate 25 is formed with flange 26, the near side edge of gate 25 is formed with flange 27, and the far edge of the gate is formed with flange 28 (FIGS. 4, 6, 7, 8 and 9). The three gate flanges 26, 27 and 28 form an integral part of the labyrinth gate seal of this invention.

The structure and operation of the labyrinth seal may best be understood after a description of the rack and capstan pinion drive for opening and closing gate 25, and also the gate lock which is described in detail in applicant's copending application, "Lock for Railway Hopper Car Gate".

In particular, conventional gate drive racks 29 and 30 are rigidly fixed to the bottom surface of gate 25 by welds (see FIGS. 3 through 9). Capstan assembly 8 (FIG. 3) incorporates a pair of pinions 31 and 32 fixed to capstan drive shaft 33. Capstan shaft 33 is rotatably supported on side frames 17 and 18 by shaft support bearings 34 and 35. Each of bearings 34 and 35 is fixed to its associated side frames 17 and 18 by a pair of bolts, such as 36 and 37 for bearing 34 (FIG. 2).

Capstan head assemblies 38 and 39 are rigidly fixed to the terminal ends of capstan drive shaft 33 (FIG. 3). Accordingly, insertion of a capstan drive bar within any capstan head opening rotates the drive shaft 33 and the accompanying pinions 31 and 32. The rotation of the pinions 31 and 32 drives racks 29 and 30, respectively, and inasmuch as the racks are rigidly fixed to gate 25, the gate opens and closes responsively to the direction of rotation of drive shaft 33.

In FIG. 4, door 25 is shown closed; and in FIG. 5 the capstan assembly 8 has been rotated clockwise so as to open gate 25.

As is best shown in FIG. 6, gate stop 40 which is a right angle bar, spans the distance between side frames 17 and 18 and is rigidly fixed to the rear terminal portions of these frames. Accordingly, the maximum opening of gate 25 is limited by gate stop 40. For example, in FIG. 5, gate 25 has been opened to the maximum opening distance which occurs when rear gate flange 26 strikes gate stop 40. Stop block 48 is fixed to the far side of flange 26 and moves therewith riding on side frame 18. In the open position of the gate, block 48 projects through a rectangular opening (not shown) formed in gate stop 40.

A counterclockwise rotation of capstan assembly 8 will close gate 25 so that the hopper outlet chute 11 will be sealed so as to contain any lading loaded within hopper car compartment 2, for example.

Slide gate 25 may be locked in the closed position shown in FIG. 4, by lock assembly 41 which is described in detail in applicant's copending application. The lock assembly forms no part of the present invention. Lock assembly 41 may be sealed by car seal 42 to indicate that gate 25 has not been tampered with and subjected to an unauthorized opening. In the main, lock 41 comprises a generally tubular shaped rod 43 having projecting lock flanges 44 and 45 (FIG. 3). As is best shown in FIG. 6, rod 43 projects through openings in side frames 17 and 18 and accordingly the lock is carried by these frames. The terminal ends of rod 43 are formed with U-shaped handle portions 46 and 47. In the locked position of gate 25, a terminal segment 46*a* of U-shaped handle 46 projects into the path of slide gate 25 so that movement of lock block 48 is obstructed (FIG. 4).

As is described in applicant's copending application, the lifting of rod 43 and the accompanying breaking of tab seal 42 enables an operator to move rod 43 upwardly in slot 49 (FIG. 5), and the projecting segment 46*a* of U-shaped lock handle 46 is removed from the path of lock block 48. Accordingly, the gate may be opened as is shown in FIGS. 5 and 6 to the maximum position at which the back gate flange 26 contacts gate stop 40.

The lock previously described is merely typical of the several types of locks which may be advantageously applied to gate 25. Several other forms of prior art locks may be advantageously applied to gate 25 to cooperate with the labyrinth seals of this invention.

Figure 8:
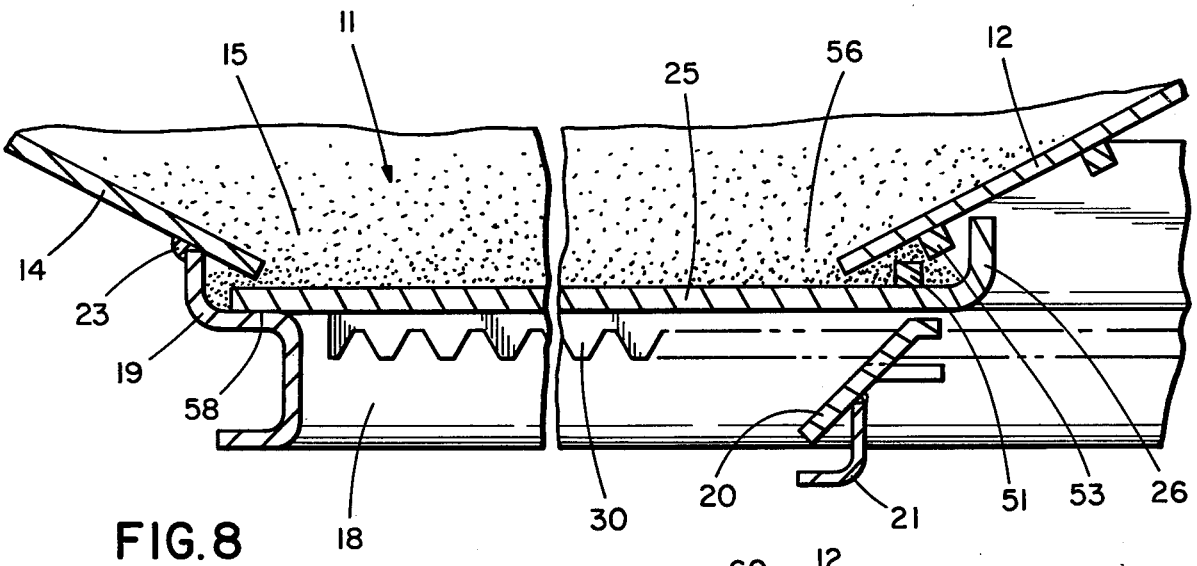
FIG. 8 is an enlarged view of portions of the gate as viewed in FIG. 4, and particularly showing the construction of the labyrinth formed at the rear edge of the hopper gate.

Referring now to FIG. 6, it will be recalled that plate-like gate 25 is formed with flange 26 on its rear edge and with flanges 27 and 28 on its near and far edges, respectively. The front edge of plate 25, as is shown in FIG. 8 for example, is formed with no flange. Accordingly, three peripheral edges or sides of rectangular plate 25 are formed with flanges and a single edge, the front edge, does not have a flange. Each of the flanges cooperates to establish a labyrinth seal, as is hereafter particularly described with respect to FIGS. 6, 7, 8 and 9. Referring to these Figures, it will be noted that elongated rectangular labyrinth seal bars 50, 51 and 52 are rigidly fixed to the top surface of gate 25 and spaced from flanges 27, 26 and 28, respectively. Similarly, an elongated, rectangular labyrinth seal bar 53 is affixed to the outside of rear sidewall 12 of hopper outlet chuts 11 (FIGS. 4, 5 and 8). This labyrinth seal bar 53 is located between labyrinth seal bar 51 and flange 26 as is best shown in FIG. 8. Likewise, elongated, rectangular seal bars 54 and 55 are rigidly fixed to the outside surfaces of chute sidewalls 13 and 15, respectively (FIGS. 7 and 9).

In a typical embodiment, rectangular seal bars 50 through 55 are $\frac{3}{8}$ inch square bars which are welded to their supporting surfaces, and the bars are so spaced so as to define a gap therebetween of approximately $\frac{1}{8}$ inch. For example, in FIG. 8 the rear labyrinth seal defined by bars 51 and 53 establishes a gap of approximately $\frac{1}{8}$ inch therebetween. The gap established between seal bar 53 and the adjacent surface of flange 26 is also approximately $\frac{1}{8}$ inch. It should be understood, however, that these gap distances are merely typical and preferred gap distances, and that some variation can be made without detracting from the efficiency of the labyrinth seals formed.

Similarly, in both side seals shown in FIG. 7, a gap distance of approximately $\frac{1}{8}$ inch is established between seal bars 52 and 53, seal bars 50 and 54, and a similar distance is established between seal bar 55 and flange 28 and also between seal bar 54 and flange 27.

Figure 9:
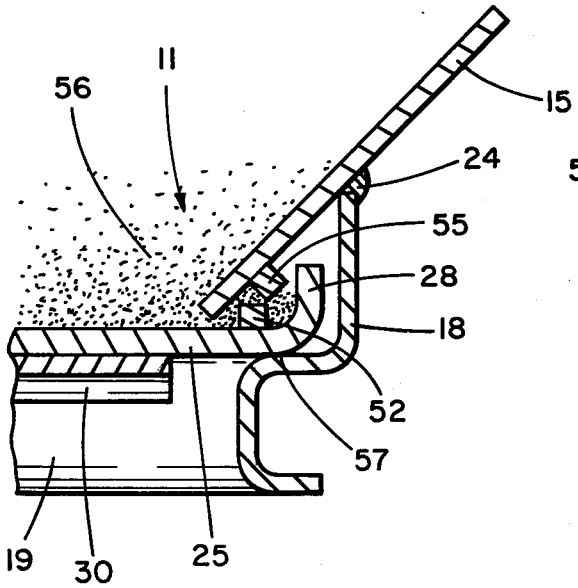
FIG. 9 is a view of a portion of the gate as viewed in FIG. 7 showing the disposition of granular lading in the gaps defined by the labyrinth seal formed on both sides of the hopper gate.

It should be noted that the labyrinth seal shown in FIG. 9, associated with side frame 18, is identical in structure with the side labyrinth seal associated with side frame 17 shown in FIG. 7. Accordingly, the following detailed description made with reference to FIG. 9 is also applicable to the near labyrinth seal formed on side frame 17.

It should be noted that in each of the rear and side labyrinth seals, that two seal bars are located in the space defined by the chute sidewall and the adjacent flange. In the preferred embodiment of the rear seal shown in FIG. 8, seal bar 51 presents a relatively flat perpendicular surface to granular lading 56 contained within hopper outlet chute 11. When the chute is loaded with lading 56, the perpendicular surface tends to obstruct the movement of the lading around seal bar 51. However, to the extent that the lading tends to flow above seal bar 51, it again strikes a generally perpendicular surface presented to the lading by seal bar 53. Experiments and tests have shown that in substantially all instances, the granular lading cannot traverse the tortuous labyrinth path provided by sidewall 12, seal bars 51, 53 and flange 26 so as to leak from the opening between the upper edge of flange 26 and the adjacent surface of chute sidewall 12.

Correspondingly, in the typical sidewall seal shown in FIG. 9, seal bars 52 and 55 present perpendicular and flat surfaces to granular lading 56. Here again, in the usual instance the lading cannot effect the tortuous labyrinth path defined by the chute sidewall 15, seal bars 52, 55, and flange 28. In the event, however, the integrity of a side labyrinth seal is breached and lading flows over and around the upper surface of flange 28 (or flange 27 as the case may be) so as to pass into the gap defined by the right edge of flange 28 and the left edge of side frame 18, a secondary contact seal is provided at contact area 57 which serves as an additional and secondary seal for the labyrinth. In particular, contact seal, such as seal 57, is provided at each of the sidewalls by the lower surface of gate 25 and the upper gate contacting surface of the side frame 17 or 18, as the case may be.

As is shown in FIG. 8, a labyrinth seal is not formed at the front or left edge of plate 25 in the area of front frame 19. A contact seal is established at area 58 where the lower surface of gate 25 contacts the upper surface of front frame 19.

Accordingly and in brief summary, in the first preferred embodiment of the labyrinth seal of this invention, a labyrinth seal is formed on both sides and the rear of the gate, but not at the front of the gate. Additionally, a contact seal is formed on both sides of the gate and also at the front of the gate. These contact seals serve as a supplement to the side labyrinth seals and as the only seal for the front of the gate. A supplementary contact seal is not formed at the rear of the gate. Accordingly, the labyrinth seal functions as the sole seal at the rear of the gate.

Figure 10:
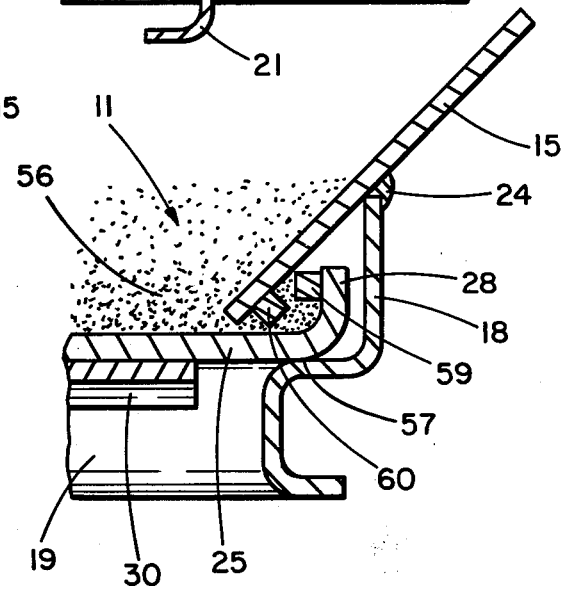
FIG. 10 is a section view of an alternate preferred embodiment of the labyrinth seal as applied to seal the sides of a hopper gate.

An alternative preferred embodiment of the side labyrinth seal is shown in FIG. 10. In this embodiment, side seal bar 52 (FIG. 9) is omitted from the upper surface of gate 25. Seal bar 59 is located, however, on the inside surface of flange 28 immediately adjacent a seal bar 60 which is located on the outside surface of chute sidewall 15. Accordingly, granular lading 56 contained within hopper chute 11 is first obstructed by the adjacent surface of seal bar 60. Subsequently, any lading passing the gap between seal bar 60 and the upper surface of gate plate 25 is obstructed by the lower surface of seal bar 59. The gaps between seal bars 59 and 60, between seal bar 60 and plate 25, and between seal bar 59 and the adjacent outside surface of chute 11 are approximately ⅛ inch in width.

Figure 11:
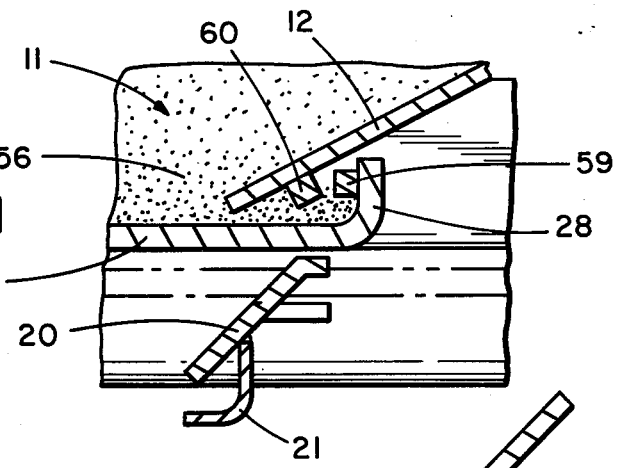
FIG. 11 is a section view of the labyrinth seal formed on the rear edge of the gate when the alternative side seal of FIG. 10 is employed.

If the alternative side seal embodiment of FIG. 10 is employed, the seal associated with rear flange 26 must also be modified to the alternative form shown in FIG. 11. In FIG. 11, seal bar 61 is fixed to the inside surface of flange 26, and seal bar 62 is fixed to outside surface of chute sidewall 12. The gaps between adjacent surfaces are also approximately ⅛ inch in width.

In view of the fact that the labyrinth seal designs of this invention depend upon the tortuous paths defined by the gaps located between various elements, mechanical distortions can be tolerated with a labyrinth seal and still minimize the unwanted discharge of granular lading 56. Any mechanical distortions in seals employing friction or contact elements, however, cannot be so tolerated without usually resulting in a severe leakage and waste of lading.

It should be understood that the above described arrangements are merely illustrative of the principles of this invention, and that modifications can be made without departing from the scope of the invention.

What is claimed is:

1. In a hopper outlet chute having a discharge opening defined by a sidewall frame with a sliding plate gate operating in the opening and an undercarriage support frame fixed to the chute sidewall frame to support the gate for sliding movement relative the opening, an improved gate seal comprising an upwardly directed gate flange integrally formed on at least part of the periphery of the gate plate, the flange being disposed on the outside of the chute frame, a pair of spaced elongated seal elements disposed in the space betweeen the gate flange and the adjacent hopper sidewall frame with one of the seal elements being fixed to the gate and the other to the adjacent chute sidewall frame and with both seal elements defining a tortuous labyrinth gap therebetween which serves as a seal for any granular matter within the chute.

2. The combination of claim 1 in which the first seal element is an elongated bar fixed to the gate and the second seal element is an elongated bar fixed to the chute frame with a generally uniform gap width being defined by the seal elements.

3. The combination of claim 2 in which both seal elements are also spaced from the adjacent gate flange whereby lading is sealed by the tortuous path established by the gaps between the seal bars and the adjacent chute sidewall and flange.

4. The combination of claim 2 in which the first seal element is fixed to the inside of the gate flange and the second seal element is fixed to the chute frame with a generally uniform gap width being defined by the seal elements whereby lading is sealed by the tortuous path established by the gaps between the seal bars and the adjacent chute sidewall and flange.

5. The combination of claim 2 in which both seal bars are rectangular in cross-section, and in which the gate directly contacts the undercarriage frame for friction sliding movement thereon to establish a secondary friction contact seal.

6. In a hopper outlet chute having a rectangular discharge opening defined by an inclined sidewall frame with a sliding rectangular platelike gate operating in the opening and an undercarriage support frame fixed to the sidewall frame to support the gate for sliding movement relative the opening, an improved gate seal comprising, an upwardly directed gate flange integrally formed on both sides of the gate plate, each flange being disposed between the outside of the chute frame and the inside of the undercarriage frame, a pair of spaced elongated seal elements disposed in each space between a gate flange and the adjacent hopper sidewall frame with one of the seal elements being fixed to the gate and the other to the adjacent chute sidewall frame and with both seal elements defining a labyrinth gap therebetween which serves as a seal for any granular matter within the chute.

7. The combination of claim 6 in which each side of the platelike gate rests on and is slidably supported on the undercarriage support frame whereby the gate and the support frame contact areas form secondary side seals.

8. The combination of claim 7 in which each of the seal elements is an elongated rectangular bar and in which the upper edge of each flange is spaced from the adjacent sidewall surfaces of the outlet chute.

9. The combination of claim 6 in which an upwardly directed flange is also formed on the rear edge of the gate, and a pair of spaced elongated seal elements is disposed in the space between the rear edge flange and the adjacent hopper sidewall frame with one of the seal elements being fixed to the gate and the other to the adjacent chute sidewall frame with both seal elements defining a labyrinth gap therebetween which serves as a rear seal for any granular matter within the chute.

10. The combination of claim 9 in which each of the additional seal elements is an elongated rectangular bar and in which the upper edge of the rear flange is spaced from the adjacent sidewall surfaces of the outlet chute.

* * * * *